United States Patent [19]

Fuse et al.

[11] Patent Number: 4,929,248

[45] Date of Patent: May 29, 1990

[54] SILK FIBER HAVING GOOD ABRASION RESISTANCE AND GOOD LIGHT RESISTANCE AND METHODS FOR THE PREPARATION THEREOF

[75] Inventors: Toshikazu Fuse, Nagahama; Atsushi Yamamoto, Hikone; Junji Sano, Amagasaki, all of Japan

[73] Assignee: Kanebo Co., Ltd., Tokyo, Japan

[21] Appl. No.: 186,846

[22] Filed: Apr. 27, 1988

[30] Foreign Application Priority Data

Apr. 28, 1987 [JP] Japan ..... 62-103199
Feb. 19, 1988 [JP] Japan ..... 63-35126

[51] Int. Cl.[5] ..... D06M 3/02; D06M 13/00
[52] U.S. Cl. ..... 8/128.1; 8/127.5
[58] Field of Search ..... 8/128 R, 127.5

[56] References Cited

FOREIGN PATENT DOCUMENTS 8581369 1/1980 Japan .

OTHER PUBLICATIONS

Henry Lee, et al., Epoxy Resins, McGraw-Hill (1957) pp. 45–48.

*Primary Examiner*—Paul Lieberman
*Assistant Examiner*—John F. McNally
*Attorney, Agent, or Firm*—Nixon & Vanderhye

[57] ABSTRACT

The present invention provides silk fiber crosslinked with an epoxy compound, characterized in that solubility of the silk fiber is 30% by weight or less when the silk fiber is soaked in an aqueous 5 wt. % sodium hydroxide solution at a temperature of 65° C. for 60 minutes, and dyeing depth, K/S, at 520 nm with 9% owf. of a red reactive dye, color Index Reactive Red 63 at the temperature of 60° C. for 60 minutes is 7 or less. The silk fiber has improved properties including long term resistance to light deterioration and resistance to fibrillation.

10 Claims, 3 Drawing Sheets

SILK FIBER HAVING GOOD ABRASION RESISTANCE AND GOOD LIGHT RESISTANCE AND METHODS FOR THE PREPARATION THEREOF

FIELD OF THE INVENTION

This invention relates to silk fiber having improved properties such as durable abrasion resistance and durable light resistance, and methods for the preparation thereof.

BACKGROUND OF THE INVENTION

Methods to durably improve properties of silk are known in which epoxides are used. For instance, a method is known in which an epoxy type synthetic resin is padded, dried and cured together with a catalyst selected from amines, acids and acid salts (Japanese Patent Publication No. 1958/10654). However, the envisaged maintenance of whiteness is not so improved. Another method is also known in which an epoxy polymer is padded, dried and steamed or cured using an alkali metal hydroxide or an alkaline salt of an alkali metal as a catalyst (Japanese Patent Publication No. 1963/25198). However, this method is not suitable for practical use, because embrittlement and yellowing of the silk take place easily due to the treatment at high temperatures in the presence of a strongly basic catalyst. A method is also known in which silk is dipped in a solution or emulsion of epoxide and a neutral salt in water or an organic solvent, and then subjected to heat treatment (Japanese Patent Publication No. 1972/24199). However, this method is not suitable for practical use, because a large amount of the neutral salt is required and it is difficult to control the reaction, which leads to the deterioration of silk in many cases. A method is also known in which silk is impregnated with an aqueous solution of a neutral salt, and then heated in a solution of an epoxide in an organic solvent (Japanese Patent Publication No. 1977/38131). However, this method is inferior in economy, because special equipment for environmental pollution prevention, such as a closed system and a recovery system are required, owing to the use of the organic solvent. Further, a method is also known in which silk is dipped in an aqueous solution containing a polyalcohol type epoxy compound and an alkali metal salt of monocarboxylic acid, and then subjected to steaming (Japanese Patent Application Laid-Open No. 1985/81369). However, the modification effects are insufficient. That is, although crease recovery and alkali resistance are fairly improved, the processed product shows only an insufficient prevention of yellowing by sunlight. Another method is known in which silk is given a sprayed or foamed composition containing a neutral salt or weakly basic salt and an epoxide, to which it is then microwave irradiated (Japanese Patent Application Laid-Open 1986/6828). However, the reaction is difficult to control, so that the reproducibility is bad and uniform treatment is difficult to attain without embrittlement.

Further, there is another problem common in all of the above methods. That is, the processed product itself yellows compared to the unprocessed one, so that bleaching is needed.

To lessen such yellowing, a method is known in which silk is impregnated with an aqueous solution of a polyalcohol type glycidyl ether and an alkali metal hydroxide or an alkaline salt of alkali metal, and is allowed to stand (Japanese Patent Applications Laid-Open Nos. 1987/85078 and 1987/85079). However, the attained effect of preventing the yellowing is not sufficient.

In addition, silk fiber has such a disadvantage that abrasion is easily caused by washing. The abrasion resulted from fibrillation of the fibers. No effective method for preventing the fibrillation has been found yet.

SUMMARY OF THE INVENTION

An object of the present invention is to provide silk fiber which shows less abrasion and less yellowing caused by light, particularly less yellowing in long-term irradiation of light.

Another object of the invention is to provide silk fiber which has good and durable chlorine resistance, nitrogen oxide resistance, chemical resistance and wash-and-wear property.

Another object of the invention is to provide methods of preparing such silk fiber, in which the silk is not deteriorated, the feeling of the silk is not damaged, the silk does not yellow so that bleaching after the processing is unnecessary, wherein the methods may be carried out in an aqueous system so that no special equipments are required.

It has now been found that in the crosslinking treatment of silk fiber with epoxy compounds the prevention of the abrasion of silk fiber is due to an appropriate degree of the crosslinking and, meanwhile, the prevention of the yellowing is due to an appropriate degree of blockage of the hydroxyl end groups of silk. Then, it has also been found that the appropriate degree of the crosslinking may be correlated with solubility of the silk in an aqueous alkali solution and the appropriate degree of blockage of the hydroxyl end groups may be correlated with depth of dyeing by the use of a certain reactive dye, which finding leads to silk fiber that shows such excellent prevention of abrasion and prevention of yellowing as unattainable previously, and methods of preparing such silk fiber.

That is, the present invention provides silk fiber crosslinked with an epoxy compound, characterized in that solubility of the silk fiber is 30% by weight or less when the silk fiber is soaked in an aqueous 5 wt.% sodium hydroxide solution at a temperature of 65° C. for 60 minutes, and dyeing depth, K/S, at 520 nm with 9% owf. of a red reactive dye, Color Index Reactive Red 63 at the temperature of 60° C. for 60 minutes is 7 or less.

The above silk fiber may be prepared by one of the following mathods.

One alternative according to the invention is a method of processing silk fiber, characterized in that an aqueous solution containing a water-soluble epoxy compound and a catalyst selected from the group consisting of alkali metal or alkali earth metal salts of dicarboxylic acids, tricarboxylic acids and amino polycarboxylic acids, amines such as 2-methyl imidazole, triethylenetetramine and 2,4,6-tris(dimethylaminomethyl)phenol, and magnesium chloride is applied to the silk fiber, and then subjected to heat treatment. This method is hereinafter called a heat treatment method.

The other alternative according to the invention is a method of processing silk fiber wherein an aqueous processing liquid containing a water-soluble epoxy compound and a catalyst is applied to the silk fiber and is allowed to stand at room temperature in the condition of preventing transpiration of the water, characterized in that the catalyst is such that an aqueous solution of the catalyst alone without the epoxy compound has a pH of less than 11 and the processing liquid containing the water-soluble epoxy compound and the catalyst has a pH of at least 9. This method is hereinafter called a cold batch method.

BRIEF DESCRIPTION OF THE DRAWINGS

FIG. 1 is a photograph of unprocessed silk fiber after washing five times, which is rated as class 1.

FIG. 5 is a photograph of silk fiber before washing, which is rated as class 5.

FIGS. 2 to 4 are photographs of processed and washed silk fibers showing various extent of abrasion, which are rated as classes 2, 3 and 4, respectively.

DETAILED DESCRIPTION OF THE INVENTION

In the present invention, the solubility means a loss in weight of the silk fiber after it is soaked in an aqueous 5 wt. % sodium hydroxide solution at the temperature of 65° C. for 60 minutes. The solubility is required to be 30% by weight or less, preferably 20% by weight or less. The solubility is related to the extent of abrasion during the washing of silk fiber. When the solubility is 30% by weight or less, the class of abrasion is 3 or higher. If the solubility is 20% by weight or less, the class of abrasion is 5 or 4. The classes or abrasion were determined by washing a cloth of silk fiber five times in the manner according to JIS (Japanese Industry Standard) L 0217 105, taking a picture of it by a scanning electronmicroscope (×1,000) and observing the photograph to rate the extent of fibrillation of the fiber. In the case of silk fiber which is not processed with the epoxy compound, entanglement of many fibrillated fine fibers is observed throughout the photograph, which is rated as class 1. In contrast, almost no fibrillation is observed in the silk fiber that has not yet washed, which is rated as class 5. When a few fibrillated fine fibers are observed, the class is 4. When fibrillated fine fibers are a little entangled, the class is 3. When fibrillated fine fibers are entangled to create clumps, the class is 2.

Figure 1:
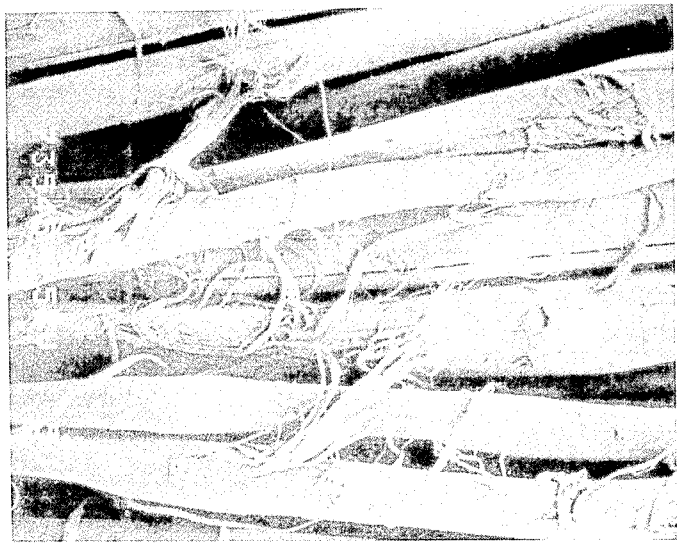
FIGS. 1 to 5 are photographs of various silk fibers taken by a scanning electronmicroscope (×1,000). Those were used as a standard to evaluate abrasion.
Figure 2:
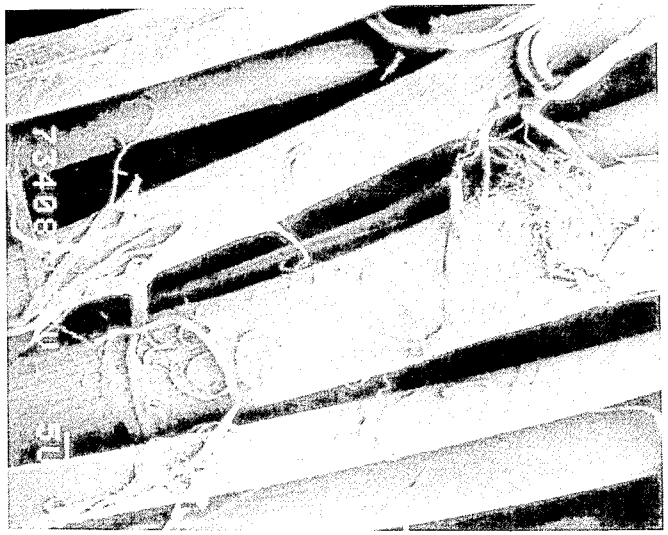
Figure 3:
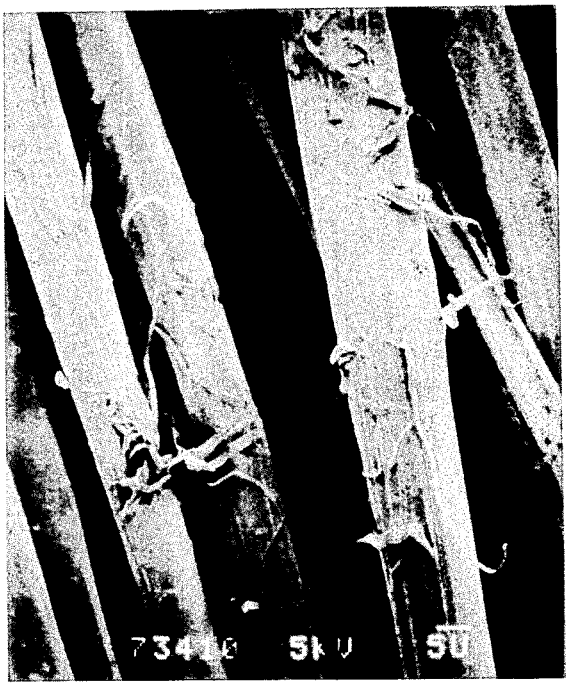
Figure 4:
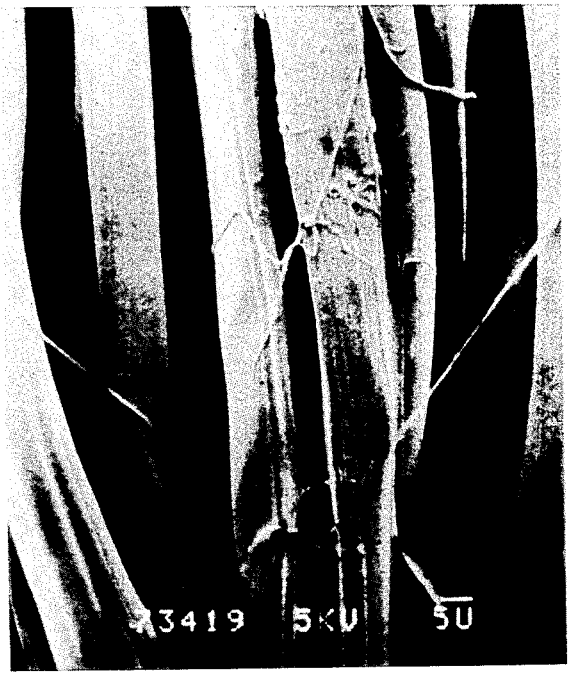
Figure 5:
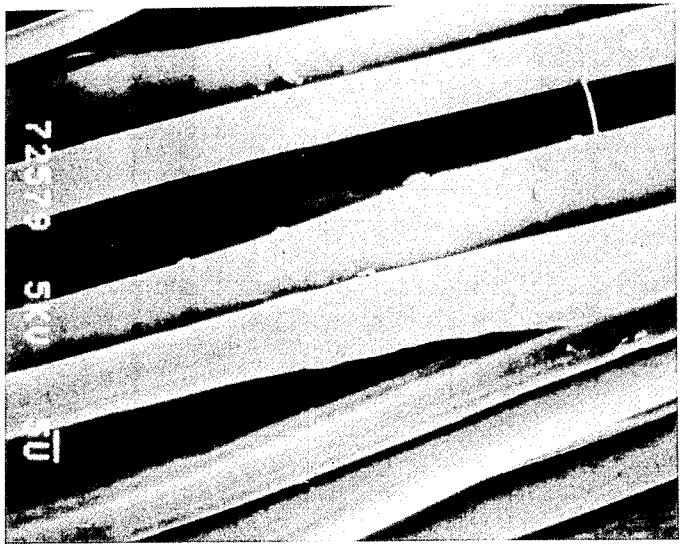

FIGS. 1 to 5 are photographs (×1,000) of silk fibers of classes 1 to 5, respectively, taken by a scanning electronmicroscope. The rating of abrasion was conducted by comparison with these photographs. The relation of the solubility to the abrasion will also be shown in the following Examples.

The silk fiber of the invention shows the dyeing depth of 7 or less, preferably 5 or less. The dyeing depth herein means the K/S at 520 nm of the silk fiber which is dyed with 9% owf. (per cloth weight) of a red reactive dye, Color Index Reactive Red 63 (Remazol Brilliant Red GD, Hoechst AG) at the temperature of 60° C. for 60 minutes. If the dyeing depth exceeds 7, the light resistance, i.e. prevention of yellowing, of the silk fiber is insufficient. To evaluate the light resistance, reflectance is determined according to JIS L 0842 after 60 hours irradiation. An yellowing index is calculated from the measured reflectances according to the following equation:

$$\text{Yellowing index} = \frac{\text{Reflectance at 650 nm} - \text{Reflectance at 425 nm}}{\text{Reflectance at 550 nm}} \times 100$$

The smaller the yellowing index is, the better the light resistance is. The radiation of the dyeing depth to the yellowing index will also be shown in the following Examples.

Processed silk fiber has not been known in the prior art which shows both the solubility of 30 wt.% or less and the dyeing depth of 7 or less.

The silk fiber of the present invention may be prepared by either the aforesaid heat treatment method or the cold batch method. As stated above, in the heat treatment method, an aqueous solution containing a water-soluble epoxy compound and a catalyst selected from the group consisting of alkali metal or alkali earth metal salts of dicarboxylic acids, tricarboxylic acids and amino polycarboxylic acids, amines, and magnesium chloride is applied to the silk fiber, and then subjected to heat treatment.

Preferred catalysts are alkali metal or alkali earth metal salts of dicarboxylic acids, tricarboxylic acids and amino polycarboxylic acids. The dicarboxylic acids herein include oxalic acid, malonic acid, succinic acid, maleic acid, fumaric acid, phthalic acid, tartaric acid, malic acid and the like. Oxalic acid, tartaric acid and malic acid are particularly preferred. A preferred tricarboxylic acid is citric acid. The amino polycarboxylic acids include ethylenediaminetetraacetic acid and diethylenetriaminepentaacetic acid with diethylenetriaminepentaacetic acid being preferred. The alkali metal and alkali earth metal include Li, Na, K, Rb, Cs, Ca and Ba with Na and K being preferred. Particularly, sodium tartrate is preferred for its excellent effect. Generally, the amount of the catalyst to be used is 0.5 to 20 wt.%, preferably 1 to 15 wt.%, based on the total weight of the processing liquid.

The amines such as 2-methyl imidazole, triethylenetetramine and 2, 4, 6-tris (dimethylaminomethyl) phenol may also be used as the catalyst.

Acid salt, specifically magnesium chloride, may also be used.

The water-soluble epoxy compound is preferably di- or polyglycydyl ether with an epoxy equivalent of 500 or less. For example, di- and polyglycidyl ether of ethylene glycol, polyethylene glycol, propylene glycol, polypropylene glycol, glycerin, sorbitol, polyglycerol, pentaerythritol, tris(2-hydroxyethyl)isocyanurate, trimethylolpropane, neopentyl glycol, phenol ethylene oxide and laurly alcohol ethylene oxide may be mentioned. Particularly preferred epoxy compounds are di- or polyglycidyl ether of ethylene glycol, polyethylene glycol, propylene glycol, polyproylene glycol and phenol ethylene oxide. More particularly, ethylene glycol diglycidyl ether and polyethylene glycol diglycidyl ether are preferred for their excellent effect.

The amount of the water-soluble epoxy compound to be applied may vary depending upon the epoxy equivalent, etc., and is generally 1 to 20 wt.%, preferably 3 to 10 wt.%, based on the weight of silk fiber, when a dipping method is used as will be described below. In a pad-steaming method or a pad-dry-steaming method, the amount is 3 to 50 wt.%, preferably 6 to 40 wt.%.

To heat-treat the silk fiber one may use a dip-heating method, a pad-steaming method or a pad-dry-steaming method. In the dip-heating method, the heat treatment is carried out, for example, at temperatures of 50° to 110° C., preferably 60° C. to 95° C. In the pad-steaming method, the aqueous solution of 50 to 200 wt.%, preferably 80 to 120 wt.%, based on the silk fiber, is applied to the silk fiber, which is then steamed by saturated steam of temperatures of 120° C. or below, preferably below 110° C. In the pad-dry-steaming method, the aqueous solution of, for example, 50 to 200 wt.%, preferably 80 to 120 wt.%, based on the silk fiber, is applied to the silk fiber, which is then dried at temperatures of 50° to 100° C., and steamed by heated steam of temperatures of 150° C. or below or by saturated steam of temperatures of 120° C. or below, preferably below 110° C. The dip-heating method is preferred. After the heat treatment, the silk fiber is washed with warm water, soaped, washed with warm water and washed with water in a conventional manner. Light resistance may further be improved by bleached before or at the same time with the soaping. The bleaching may be carried out in a conventional manner. However, it may preferably be done with a liquid containing hydrogen peroxide and sodium silicate.

In the second alternative method for the preparation of the silk fiber according to invention, an aqueous processing liquid containing a water-soluble epoxy compound and a catalyst is applied to the silk fiber and is allowed to stand at room temperature in the condition of preventing transpiration of the water. The used catalyst is such that an aqueous solution of the catalyst alone without the epoxy compound has a pH of less than 11 and the processing liquid containing the water-soluble expoxy compound and the catalyst has a pH of at least 9.

In this method, the silk fiber is allowed to stand at room temperature, for instance, 10° to 40° C., preferably 20° to 35° C., for the period of, preferably, 20 hours or longer, without being subjected to heat curing, steaming of dip-heating.

In order to proceed with the sufficient processing, i.e., reaction of the water-soluble epoxy compound with the silk, during the standing at room temperature, the catalyst must be such one that makes the pH of the processing liquid at least 9. It should be noted that what is requested here is not that the pH of the aqueous solution of the catalyst be at least 9, but that the pH of the processing liquid containing both the catalyst and the water-soluble epoxide be at least 9.

Meanwhile, it has also been found that the light resistance lasting for a long time can be attained using a catalyst which shows a pH value of less than 11.0, preferably less than 10.0, in an aqueous solution of it alone. Where the pH of an aqueous solution of the catalyst alone is less than 11.0, particularly less than 10.0, a processed cloth has only slightly better 60 hours light resistance, but has remarkably superior 120 hours light resistance, compared to the case where such a pH is not less than 11.0. Therefore, alkali metal hydroxides such as sodium hydroxide and potassium hydroxide or alkaline salts of alkali metals such as sodium bicarbonate, sodium sesquicarbonate and sodium carbonate, as used in the prior art (Japanese Patent Application Laid-Open Nos. 1987/85078 and 1987/85079), must not be used in the present invention.

The process of the invention is carried out at room temperature. Therefore, some catalysts which cause deterioration of silk in the heating process as in the prior art may be used in the present invention. As Examples of the catalysts usable in the invention there may be mentioned neutral salts such as alkali metal salts of sulfuric acid, hydrochloric acid, nitric acid, thiocyanic acid and thiosulfuric acid, weakly alkaline salts such as alkali metal salts of tartaric acid, citric acid, acetic acid and propionic acid, and amines. Preferred neutral salts are sodium salts and potassium salts of sulfuric acid, hydrochloric acid, nitric acid, thiocyanic acid and thiosulfuric acid. Preferred weakly alkaline salts are sodium salts and potassium salts of tartaric acid, citric acid, acetic acid and propionic acid. Preferred amines are ethylenediamine, diethylenetriamine, triethylenetetramine, dimethylaminopropylamine, m-phenylenediamine, 2, 4, 6-tris(dimethylaminomethyl)phenol, 2-methylimidazole and dimethylaniline. Acidic salts may also be used. Those which give a pH of the processing liquid (including the epoxy compound and the catalyst) of at least 9, such as magnesium chloride, may be used.

The catalyst is used in such an amount that it is applied to the silk in the amount of 0.3 to 15 wt.%, preferably 0.5 to 10 wt.%, based on the weight of silk.

The water-soluble epoxy compound which may be used in this method includes mono- and polyglycidyl ethers of ethylene glycol, polyethylene glycol, propylene glycol, polypropylene glycol, glycerin, sorbitol, polyglycerol, pentaerythritol, tris(2-hydroxyethyl) isocyanurate, trimethylol propane, neopentyl glycol, phenol ethylene oxide, and lauryalcohol ethylene oxide. The epoxy compound has preferably an epoxy equivalent of 500 or less. Preferred are polyglycidyl ethers of polyglycerol, ethylene glycol, polyethylene glycol, propylene glycol, polypropylene glycol, ethylene oxides and propylene oxides such as phenol ethylene oxide and laurylalcohol ethylene oxide. Particularly, diglycidyl ethers of ethylene glycol, polyethylene glycol, propylene glycol and polypropylene glycol are excellent in effects. These water-soluble epoxy compounds are used by being dissolved in water. However, those which have rather a low solubility in water may be dissolved in a medium consisting of a small amount of an organic solvent such as dioxane or isopropylalcohol and water. It is preferred to select the concentration of the water-soluble epoxy compound in the processing liquid so that when the processing liquid is applied to the silk the epoxy compound of 5 to 50 wt.%, preferably 10 to 40 wt.%, based on the weight of the silk, is applied.

In the processing of silk fiber with the water-soluble epoxy compound and the catalyst, it is preferred to use silk fiber which has been secured and bleached. To apply the processing liquid to the fiber, any proper methods such as padding, spraying and coating may be used. The processing liquid is preferably applied in the amount of 75 to 115%, based on the weight of the silk. Then the silk is allowed to stand at room temperature in the condition of preventing the water from transpirating, for instance, by rolling the silk and covering it with a film or the like. The room temperature herein is preferably at least 10° C. and at most 40° C., preferably at least 20° C. and at most 35° C. When the temperature is lower than 10° C., the reaction rate is slow so that the process takes a too long a time. On the other hand, when the temperature is higher than 40° C., the processed cloth sometimes becomes yellow so that bleaching is required. The period of time when the cloth is allowed to stand at room temperature depends upon the exact temperature and composition of the processing liquid, and is preferably selected so that the reaction proceeds sufficiently taking 20 hours or more. If the conditions are set so that the reaction proceeds sufficiently within 20 hours, the processing liquid may be unstable and the fiber may become stiff in some cases. It is preferred that the silk fiber is given movement, for instance, by being rolled and rotated so as to prevent uneven application of the liquid.

Then the processed silk fiber may be soaped with an aqueous solution of a surface active agent, washed with warm water and water, and dry-set to obtain a final product.

The silk fiber and the methods for the preparation thereof according to the invention will further be explained by Examples below. These Examples are not restrictive, but just to illustrate the invention.

In Examples, yellowing indices and solubilities were determined as described above. A nitrogen oxide resistance test and a chlorine resistance test were carried out in accordance with JIS L 0855 strengthened test and JIS L 0884 strengthened test, respectively, and the resultant resistances were expressed by the values of yellowing indices of the tested cloths. Increase in weight was calculated according to the following formula:

$$\text{Increase in weight} = \frac{\text{Weight of cloth after processing} - \text{Weight of cloth before processing}}{\text{Weight of cloth before processing}} \times 100$$

Examples 1 to 39 relate to the heat treatment method, and Examples 40 to 52 relate to the cold batch method.

EXAMPLES 1 TO 6 AND COMPARISON EXAMPLES 1

A silk cloth called Fuji Silk with a density of 70 g/m$^2$ was used, which was singed and scoured in a conventional manner. A processing liquid was applied to the fiber by the padding with an aqueous solution containing 30 wt.% of polyethylene glycol diglycidyl ether (trade mark Denacol EX-821, Nagase Kasei Kogyo Co.) as a water-soluble epoxy compound and the catalyst shown in Table 1 at the pickup of 75 to 80%. Then, the cloth was dried at 100° C. for 2 minutes and steamed with saturated steam at 102° C. for 30 minutes. The cloth was then bleached, washed with warm water and water, dried and tentered according to a conventional manner. The results are as shown in Table 1. The yellowing indices in the Table are those after 60 hours irradiation.

In Comparison Example 1, sodium acetate was used as a typical example of monocarboxylic acid disclosed in the above-mentioned Japanese Patent Application Laid-Open No. 1985/81369.

TABLE 1

| Catalyst | | | |
|---|---|---|---|
| Species | Amount used (wt. %) | pH of aqueous solution | pH of processing liquid |
| Example | | | |
| 1 Sodium tartrate | 10 | 8.1 | 11.7 |
| 2 Pentasodium diethylenetriaminepentaacetate | 1 | 10.9 | >12 |
| 3 2-Methyl imidazole | 1 | 10.3 | 11.9 |
| 4 Triethylene tetramine | 1 | 10.8 | 11.5 |
| 5 2,4,6-Tris (dimethylaminomethyl) phenol | 4 | 10.6 | >12 |
| 6 Magnesium chloride (30% aqueous solution) | 4 | 6.0 | 11.1 |

TABLE 1-continued

| Catalyst | | | |
|---|---|---|---|
| Comparison Example | | | |
| 1 Sodium acetate | 5 | 7.9 | 10.5 |
| Not processed | — | — | — |

| Species | Solubility in alkali (%) | Abrasion (class) | Dyeing depth (K/S) | Yellowing index after irradiation |
|---|---|---|---|---|
| Example | | | | |
| 1 Sodium tartrate | 19.5 | 4 | 6.7 | 20.1 |
| 2 Pentasodium diethylenetriaminepentaacetate | 17.2 | 5 | 4.1 | 19.3 |
| 3 2-Methyl imidazole | 15.1 | 5 | 5.9 | 19.0 |
| 4 triethylene tetramine | 13.9 | 5 | 6.2 | 19.7 |
| 5 2,4,6-Tris (dimethylaminomethyle) phenol | 16.6 | 5 | 6.3 | 19.4 |
| 6 Magnesium Chloride (30% aqueous solution) | 18.2 | 4 | 6.1 | 20.3 |
| Comparison Example | | | | |
| Sodium acetate | 31.2 | 3 | 8.3 | 24.6 |
| Not processed | 77.0 | 1 | 21.2 | 26.0 |

EXAMPLES 7 TO 9 AND COMPARISON EXAMPLES 2 AND 3

Flat crape with a density of 70 g/m$^2$, scoured in a conventional manner, was dipped in an aqueous solution containing 3 wt.% of ethylene glycol diglycidyl ether (trade mark Denacol EX-810, Nagase Kasei Kogyo Co.) as a water-soluble epoxy compound and the catalyst shown in Table 2 at the temperature of 80° C. for 60 minutes. After the dipping treatment, the flat crape was bleached and then soaped, washed with warm water and water, dried and tentered in a conventional manner. The results obtained are as shown in Table 2.

In Comparison Examples 2 and 3, sodium thiosulfate and potassium thiocyanate were used, respectively, which are disclosed in the above-mentioned Japanese Patent Publication No. 1972/24199.

TABLE 2

| Catalyst | | | |
|---|---|---|---|
| Species | Amount used (wt. %) | pH of aqueous solution | pH of processing liquid |
| Example | | | |
| 7 Sodium citrate | 10 | 8.2 | 11.2 |
| 8 Pentasodium diethylenetriaminepentaacetate | 1 | 10.9 | >12 |
| 9 2-Methylimidazole | 1 | 10.3 | 11.6 |
| Comparison Example | | | |
| 2 Sodium thiosulfate | 8 | 7.0 | >12 |
| 3 Potassium thiocyanate | 5 | 9.4 | >12 |
| Not processed | — | — | — |

| Species | Solubility in alkali (%) | Abrasion (class) | Dyeing depth (K/S) | Yellowing index after irradiation |
|---|---|---|---|---|
| Example | | | | |
| 7 Sodium citrate | 13.1 | 4 | 4.0 | 18.0 |
| 8 Pentasodium diethylenetriaminepentaacetate | 9.4 | 5 | 4.6 | 17.3 |
| 9 2-Methylimidazole | 11.7 | 5 | 6.8 | 17.5 |
| Comparison Example | | | | |
| 2 Sodium thiosulfate | Yellowed and embrittled | | | 27.0 |
| 3 Potassium thiocyanate | Stiffened | | | 29.5 |
| Not processed | 60.3 | 1 | 23.8 | 25.8 |

EXAMPLES 10 AND 16 COMPARISON EXAMPLES 4 TO 6

Satin with a density of 70 g/m$^2$, scoured in a conventional manner, was dipped in an aqueous solution containing 3 wt.% of each of the epoxy compounds shown in Table 3 as a water-soluble epoxy compound and 10 wt.% of sodium citrate as a catalyst at the temperature of 90° C. for an hour. Then, the satin was washed with warm water and bleached in a conventional manner, followed by warm water washing, water washing, drying and tentering in this order. The results obtained are as shown in Table 3.

All of the water-soluble epoxy compounds shown in Table 3 are those of the Denacol EX series commercially available from Nagase Kasei Kogyo Co. The product numbers shown in the Table are the numbers preceded by the trade mark, Denacol EX.

TABLE 3

| Epoxy compound | Product number | Epoxy equivalent |
|---|---|---|
| Example | | |
| 0 Polyglycerol (n = 2) polyglycidyl ether | 512 | 166 |
| 1 Polyglycerol (n = 3) polyglycidyl ether | 521 | 183 |
| 2 Ethyleneglycol diglycidyl ether | 810 | 112 |
| 3 Polyethyleneglycol (n = 4) diglycidyl ether | 821 | 195 |
| 4 Polyethyleneglycol (n = 9) diglycidyl ether | 832 | 280 |
| 5 Polyethyleneglycol (n = 13) diglycidyl ether | 841 | 394 |
| 6 Polypropyleneglycol (n = 3) diglycidyl ether | 920 | 180 |
| Comparison Example | | |
| 4 Polyethyleneglycol (n = 22) diglycidyl ether | 861 | 587 |
| 5 Laurylalcohol EO (n = 15) glycidyl ether | 171 | 1040 |
| 6 Phenol EO (n = 5) glycidyl ether | 145 | 427 |
| Not processed | — | — |

| | Solubility in alkali (%) | Abrasion (class) | Dyeing depth (K/S) | Yellowing index after irradiation |
|---|---|---|---|---|
| Example | | | | |
| 0 Polyglycerol (n = 2) polyglycidyl ether | 8.1 | 5 | 4.0 | 17.9 |
| 1 Polyglycerol (n = 3) polyglycidyl ether | 7.4 | 5 | 3.9 | 18.3 |
| 2 Ethyleneglycol diglycidyl ether | 10.1 | 5 | 4.1 | 16.9 |
| 3 Polyethyleneglycol (n = 4) diglycidyl ether | 13.3 | 5 | 4.1 | 17.1 |
| 4 Polyethyleneglycol (n = 9) diglycidyl ether | 13.8 | 4 | 4.8 | 17.3 |
| 5 Polyethyleneglycol (n = 13) diglycidyl ether | 12.6 | 4 | 5.2 | 17.4 |
| 6 Polypropyleneglycol (n = 3) diglycidyl ether | 12.0 | 5 | 4.6 | 17.0 |
| Comparison Example | | | | |
| 4 Polyethyleneglycol (n = 22) diglycidyl ether | 49.0 | 2 | 12.0 | 23.7 |
| 5 Laurylalcohol EO (n = 15) glycidyl ether | 64.2 | 1 | 15.3 | 21.3 |
| 6 Phenol EO (n = 5) glycidyl ether | 39.1 | 2 | 7.7 | 22.0 |
| Not processed | 80.1 | 1 | 21.0 | 25.1 |

EO: Ethylene oxide

EXAMPLES 17 TO 20 AND COMPARISON EXAMPLE 7

Other embodiments of the heat treatment method of the present invention will be exemplified in the following Examples. The silk fibers prepared therein met the requirements for the silk fiber of the present invention.

Scoured and bleached Silk Habutae with a density of 61.3 gm/m$^2$ was padded with an aqueous solution containing 10 wt.% of ethylene glycol diglycidyl ether (trade mark Denacol EX-810, Nagase Kasei Kogyo Co.) and 2 wt.% of the salt shown in Table 4, so that the cloth contained 90 wt.% of the processing liquied, calculated on the weight of the cloth.

TABLE 4

| | Salt | Increase in weight (%) | Yellowing index after irradiation |
|---|---|---|---|
| Example | | | |
| 17 | Sodium citrate | 5.9 | 19.8 |
| 18 | Sodium tartrate | 5.2 | 20.0 |
| 19 | Sodium malate | 4.9 | 20.4 |
| 20 | Pentasodium diethylenetriaminepentaacetate | 5.8 | 19.6 |
| Comparison Example | | | |
| 7 | Sodium acetate | 5.5 | 24.7 |

EXAMPLES 21 TO 23 AND COMPARISON EXAMPLES 8 TO 10

Scoured and bleached flat crape with a density of 70 g/m$^2$ was padded with an aqueous solution containing 10 wt.% of polyethylene glycol (n=13) diglycidyl ether and 2 wt.% of the salt shown in Table 5 at the pickup of 100%, dried at the temperature of 60° C. for 3 minutes, and then steamed with saturated steam of the temperature of 110° C. for 30 minutes, followed by soaping, water washing and drying in this order.

Sodium sulfate as disclosed in the above-mentioned Japanese Patent Publication No. 1977/38131 was used in Comparison Example 8, and sodium thiosulfate as disclosed in the above-mentioned Japanese Patent Publication No. 1972/24199 was used in Comparison Example 9. Sodium propionate was used in Comparison in Comparison Example 10 as a typical example of monocarborylic acid used in Example of the above-mentioned Japanese Patent Application Laid-Open No. 1985/81369.

TABLE 5

| | Salt | Increase in weight (%) | Yellowing index after irradiation |
|---|---|---|---|
| Example | | | |
| 21 | Sodium citrate | 6.6 | 17.5 |
| 22 | Sodium tartrate | 6.0 | 17.2 |
| 23 | Pentasodium-diethylenetriamine pentaacetate aminepentaacetate | 8.2 | 16.9 |
| Comparison Example | | | |
| 8 | Sodium sulfate | 6.3 | 23.3 |
| 9 | Sodium thiosulfate | Yellowed and embrittled | |
| 10 | Sodium propionate | 6.0 | 24.7 |

EXAMPLES 24 TO 34 AND COMPARISON EXAMPLES 11 AND 12

Scoured and bleached flat crape with a desity of 70 g/m$^2$ was dipped in an aqueous solution containing 10 wt.% of polyethylene glycol (n=13) diglycidyl ether (trade name Denacol EX-841, Nagase Kasei Kogyo Co.) and 2 wt.% of the salt shown in Table 6 at the temperature of 90° C. for an hour, and washed with warm water, and then soaped with an aqueous solution of marseilles soap of 2 g/l at the temperature of 70° C. for 20 minutes, followed by warm water washing, water washing and drying in this order.

TABLE 6

| | Salt | Increase in weight (%) | Yellowing index after irradiation |
|---|---|---|---|
| Example | | | |
| 24 | Sodium citrate | 11.0 | 17.3 |
| 25 | Sodium tartrate | 6.7 | 17.3 |
| 26 | Sodium malate | 10.5 | 17.8 |
| 27 | Potassium citrate | 7.3 | 17.6 |
| 28 | Potassium tartrate | 6.9 | 17.4 |
| 29 | Potassium malate | 7.4 | 18.0 |
| 30 | Tetrasodium ethylenediamine-tetraacetate | 5.8 | 22.4 |
| 31 | Pentasodium diethylenetri-aminepentaacetate | 7.0 | 18.7 |
| 32 | Sodium oxalate | 6.3 | 20.6 |
| 33 | Potassium oxalate | 9.8 | 19.9 |
| Comparison Example | | | |
| 11 | Sodium thiosulfate | −9.6 | 26.6 |
| 12 | Potassium thiocyanate | 45.7 | 29.5 |
| Not processed | | 0 | 25.8 |

The processed cloth obtained in Example 24 was washed 5 times according to JIS L 0217 105, and subjected to the test for light resistance. The yellowing index was 17.7. Thus, the light resistance of the silk fiber of the invention is durable to washing.

EXAMPLES 34 TO 37 AND COMPARISON EXAMPLE 13

Scoured and bleached Fuji Silk with a density of 65.6 g/m$^2$ was padded with an aqueous solution containing 10 wt.% of polyglycerol polyglycidyl ether (trade mark Denacol EX-512, Nagase Kasei Kogyo Co.), glycerol polyglycidyl ether (Denacol EX-313), ethylene glycol diglycidyl ether (Denacol EX-810), polyethylene glycol diglycidyl ether (Denacol EX-841) or laurylalcohol ethylene oxide (n=15) glycidyl ether (Denacol EX=171) as an epoxide and 2 wt.% of sodium tartrate as a salt, and dried at a temperature of 60° C. for 3 minutes. Then it was steamed with saturated steam at the temperature of 110° C. for 30 minutes, followed by warm water washing, soaping, warm water washing, water washing and drying in this order. A part of the cloth treated above was further dipped in an aqueous solution containing 3 g/l of 35% hydrogen peroxide and 4 g/l of 30° Be' sodium silicate at the temperature of 70° C. for 60 minutes to be bleached. The results obtained are as shown in Table 7.

The numerical values in parentheses in the column of the yellowing index are the yellowing indices of the bleached cloth.

TABLE 7

| | Epoxide (10 wt. %) | Increase in weight (%) | Yellowing index after irradiation |
|---|---|---|---|
| Example | | | |
| 34 | Polyglycerol polyglycidyl ether | 9.6 | 20.4 (18.1) |
| 35 | Glycerol polyglycidyl ether | 7.9 | 19.8 (17.6) |
| 36 | Ethyleneglycol diglycidyl ether | 6.4 | 19.6 (17.3) |
| 37 | Polyethyleneglycol (n = 13) diglycidyle ether | 7.5 | 18.4 (17.0) |
| Comparison Example | | | |
| 13 | Laurylalcohol Ethylene oxide (n = 15) diglycidyl ether | 5.6 | 22.5 (21.0) |
| Not processed | — | 0 | 26.0 |

EXAMPLE 38

Scoured and bleached flat crape with a density of 70 g/m$^2$ was dipped in an aqueous solution containing 5 wt.% of ethylene glycol diglycidyl ether (trade mark Denacol EX-810, Nagase Kasei Kogyo Co.) and 5 wt.% of sodium tartarate at the temperature of 90° C. for 60 minutes. Then, it was bleach-soaped with an aqueous solution containing 0.2 wt.% of a nonionic surface active agent, 0.5 wt.% of 30% hydrogen peroxide and 0.2 wt.% of 48° Be' sodium silicate at the temperature of 70° C. for 60 minutes, followed by warm water washing, water washing and drying in this order.

Table 8 shows the results (yellowing index) from the light resistance test, nitrogen oxide resistance test and chlorine resistance test, and percentage solubility (5% Na OH, 65° C., 60 minutes) for the processed cloth and unprocessed cloth.

TABLE 8

| | (Yellowing index) Processed | Unprocessed |
|---|---|---|
| Light resistance | 17.1 | 25.8 |
| Nitrogen oxide resistance | 21.0 | 22.5 |
| Chlorine resistance | 18.1 | 25.5 |
| Solubility | 20% | 75% |

EXAMPLE 39

Scoured and bleached Silk Habutae with a density of 70 g/m$^2$ was dipped in an aqueous solution containing 5 wt.% of polyglycerol polyglycidyl ether (trade mark Denacol EX-512, Nagase Kasei Kogyo Co.) and 1.6 wt.% of pentasodium salt of diethylenetriaminepentaacetic acid at the temperature of 70° C. for 2 fours. Then, it was subjected successively to warm water washing, soaping, warm water washing, water washing and drying. Table 9 shows the properties of the processed cloth in comparison with those of the unprocessed cloth.

TABLE 9

| | Property | Invention | Unprocessed |
|---|---|---|---|
| 1 | Increase in weight | 13.5% | 0 |
| 2 | Crease recovery angle (dry) | 250 | 204 |
| 3 | Crease recovery angle (wet) | 240 | 190 |
| 4 | Solubility with sodium hypochlorite | 33 | 100 |
| 5 | Yellowing index | 20.8 | 25.9 |

Items (2) and (3) were determined in accordance with a Monsanto method (warp+woof) and JIS L 1030, respectively.

As seen from Table 9, the light resistance was remarkably improved and the crease recovery and the solvent resistance were greatly increased as well.

The following Examples 40 to 52 are related to the cold batch method of the invention.

EXAMPLES 40 TO 48 AND COMPARISON EXAMPLES 14 TO 16

Scoured and bleached Fuji Silk with a density of 70 g/m$^2$ was dipped in an aqueous solution containing 20 wt.% of polyethylene glycol (n=13) diglycidyl ether (trade mark Denacol EX-841, Nagase Kasei Kogyo Co.) as a water-soluble epoxy compound and the catalyst shown in Table 10 and squeezed at the pickup of 80 to 85 wt.% to apply the processing liquid to the cloth. The cloth was immediately wound on a roll, covered with a polyethylene sheet and allowed to stand at 30° C. for 48 hours while the roll being rotated at 50 rpm. Then, the cloth was unwound and soaped with an aqueous solution of 2 g/l of Zolge NK New (trade mark, Meisei Kagaku Co.) at 70° C. for 30 minutes, followed by warm water washing, water washing, drying and tentering in this order. The result are as shown in Table 10.

In Comparison Examples 14 to 16, the used catalysts were those used in the prior art.

TABLE 10

| Catalyst | | | |
|---|---|---|---|
| Species | Amount used (wt. %) | pH of aqueous solution | pH of processing liquid |
| Example | | | |
| Sodium chloride | 10 | 7.0 | 11.6 |
| Sodium citrate | 10 | 8.2 | 9.7 |
| Sodium tartrate | 10 | 8.4 | 11.7 |
| Sodium sulfate | 5 | 6.9 | 11.0 |
| Sodium thiosulfate ($5H_2O$) | 5 | 6.8 | >12 |
| Sodium acetate | 10 | 8.6 | 12.0 |
| Magnesium chloride (30% aqueous solution) | 2 | 5.8 | 11.0 |
| 2-Methylimidazole | 1.0 | 10.0 | >12 |
| Triethylenetetramine | 1.0 | 10.3 | 11.5 |
| Comparison Example | | | |
| Sodium carbonate | 5 | 11.0 | 11.5 |
| Sodium hydroxide | 0.8 | >12 | >12 |
| Sodium bicarbonate | 5 | 8.2 | 8.7 |
| Not processed | | | |

| Species | Increase in weight (%) | Solubility in alkali (%) | Abrasion (class) | Dyeing depth (K/S) | Yellowing index after irradiation | Yellowing index after 120 hrs. irradiation* |
|---|---|---|---|---|---|---|
| Example | | | | | | |
| Sodium chloride | 11.5 | 9.5 | 5 | 2.4 | 17.3 | 17.8 |
| Solium citrate | 11.6 | 16.0 | 4 | 3.6 | 17.5 | 18.1 |
| Sodium tartrate | 9.5 | 15.0 | 4 | 3.9 | 18.0 | 19.0 |
| Sodium sulfate | 8.9 | 12.0 | 5 | 2.1 | 17.0 | 18.3 |
| Sodium thiosulfate ($5H_5O$) | 13.0 | 8.5 | 5 | 1.4 | 17.2 | 18.0 |
| Sodium acetate | 10.2 | 16.4 | 4 | 4.0 | 17.6 | 18.5 |
| Magnesium chloride (30% aqueous solution) | 12.5 | 12.3 | 4 | 3.2 | 16.9 | 17.9 |
| 2-Methylimidazole | 9.8 | 15.3 | 4 | 3.8 | 17.5 | 18.4 |
| Triethylenetetramine | 12.1 | 11.7 | 5 | 2.9 | 17.9 | 19.1 |
| Comparison Example | | | | | | |
| Sodium carbonate | 9.3 | 30.6 | 3 | 4.2 | 19.8 | 23.4 |
| Sodium hydroxide | 10.5 | 11.7 | 4 | 4.0 | 18.4 | 22.3 |
| Not processed | — | 87.0 | 1 | 15.8 | 24.2 | 27.1 |

Irradiation was continued for 120 hours instead of 60 hours.

When the pH of the processing liquid was less than 9, the increase in weight was small and the attained effects were poor (Comparison Example 16). On the other hand, when the pH of the aqueous liquid of the catalyst was 11 or higher, the 120 hours light resistance was very bad (Comparison Examples 14 and 15). For illustration, the cloth of Example 41 was subjected to the chlorine resistance test and the nitrogen oxide resistance test as described above. Further, a wash-and-wear property (W-W property) was tested in accordance with AATCC-124.

TABLE 11

| | Chlorine resistance (yellowing index) | Nitrogen oxide resistance (yellowing index) | W-W property (class) |
|---|---|---|---|
| Ex. 41 | 18.9 | 24.0 | 3 |
| Not processed | 25.1 | 24.7 | 2 |

The cloth of Example 46 was subjected to a washing durability test and a dry cleaning durability test, where the cloth was washed 10 times in accordance with JIS L 0217 105 or 3 times in accordance with JIS L 1042 J-1, respectively, and then irradiated for 60 hours in accordance with JIS L 0842 to obtain a yellowing index.

TABLE 12

| | Yellowing index before washing | Washing durability (yellowing index) | Dry cleaning durability (yellow index) |
|---|---|---|---|
| Example 46 | 16.9 | 17.9 | 17.2 |
| Not processed | 24.2 | 25.3 | 24.0 |

EXAMPLES 49 TO 52 AND COMPARISON EXAMPLES 17 TO 20

Scoured and bleached flat crape silk with a density of 70 g/m$^2$ was dipped in an aqueous solution containing 20 wt.% of ethylene glycol diglycidyl ether (trade mark Denacol EX-810, Nagase Kasei Kogyo Co.) as a water-soluble epoxy compound and the catalyst shown in Table 13, and squeezed at the pickup of 90 to 100 wt.% to apply the processing liquid to the cloth. The cloth was immediately placed in a polyethylene bag and allowed to stand at 30° C. for 24 hours or 48 hours, and then subjected to the soaping as described in Example 40, followed by warm water washing, water washing and drying in this order.

For comparison, a part of the cloth after squeezed was steamed at 102° C. for 30 minutes instead of standing at room temperature, which was then soaped as in Example 40, washed with warm water and water, and dried. The results are as shown in Table 13.

TABLE 13

| | Catalyst | | | |
|---|---|---|---|---|
| | species | Amount used (wt. %) | pH of aqueous solution | pH of processing liquid |
| Ex. 49 | Potassium thiocyanate | 4.8 | 9.4 | >12 |
| Com. 17 | Potassium thiocyanate | 4.8 | 9.4 | >12 |
| Ex. 50 | Sodium thiosulfate | 5.0 | 6.9 | >12 |
| Com. 18 | Sodium thiosulfate | 5.0 | 6.9 | >12 |
| Ex. 51 | Sodium sulfate | 5.0 | 6.8 | 9.6 |
| Com. 19 | Sodium sulfate | 5.0 | 6.8 | 9.6 |
| Ex. 52 | 2-Methyl-imidazole | 0.9 | 10.3 | >12 |
| Com. 20 | 2-Methyl-imidazole | 0.9 | 10.3 | >12 |
| Not processed | — | | | |

| | Time Period of processing | Increase in weight (%) | Yellowing index of processed cloth | Yellowing index after irradiation |
|---|---|---|---|---|
| Ex. 49 | 24 hrs. | 11.3 | 14.1 | 17.7 |
| Com. 17 | (30 min.) | | Yellowed and embrittled | — |
| Ex. 50 | 24 hrs. | 11.0 | 13.4 | 18.3 |
| Com. 18 | (30 min.) | | Yellowed and embrittled | — |
| Ex. 51 | 48 hrs. | 8.9 | 13.2 | 18.9 |
| Com. 19 | (30 min.) | 12.0 | 17.4 | 22.0 |
| Ex. 52 | 48 hrs. | 10.8 | 13.5 | 18.0 |
| Com. 20 | (30 min.) | | 18.5 | 23.9 |
| Not processed | | | 13.1 | 25.8 |

As seen from Table 13, this method according to the present invention gave the excellent results of the processing without yellowing and embrittlement. When the pad-steaming method was used for some catalysts as in the prior art, the cloth was yellowed and embrittled too much to be used in practice. Even when embrittlement did not take place as in Comparison Example 19, the cloth was yellowed so as to require bleaching for practical use. Example 51 corresponding Comparison Example 19 gave the cloth which did not require bleaching.

EXAMPLES 53 TO 59 AND COMPARISON EXAMPLES 21 TO 23

Scoured and bleached satin with a density of 70 g/m$^2$ was dipped in an aqueous solution containing 30 wt.% of the epoxy compound shown in Table 14 and 10 wt.% of sodium chloride, and squeezed at the pickup of 80 to 85 wt.% to apply the processing liquid to the cloth. The pH of the processing liquid was 11.0 to 12.0. The cloth was immediately wound on a roll covered with a polyethylene sheet and allowed to stand at 30° C. for 48 hours while the roll being rotated at 50 rpm. Then, the cloth was unwound and soaped with an aqueous solution of 2 g/l of Zolge NK New (Meisei Kagaku Co.) at 70° C. for 30 minutes, followed by warm water washing, water washing, drying and tentering in this order. The results are as shown in Table 14.

TABLE 14

| Epoxy compound | Product number | Epoxy equivalent |
|---|---|---|
| Example | | |
| 0 Polyglycerol (n = 2) polyglycidyl ether | 512 | 166 |
| 1 Polyglycerol (n = 3) polyglycidyl ether | 521 | 183 |
| 2 Ethyleneglycol diglycidyl ether | 810 | 112 |
| 3 Polyethyleneglycol (n = 4) diglycidyl ether | 821 | 195 |
| 4 Polyethyleneglycol (n = 9) diglycidyl ether | 832 | 280 |
| 5 Polyethyleneglycol (n = 13) diglycidyl ether | 841 | 394 |
| 6 Polypropyleneglycol (n = 3) diglycidyl ether | 920 | 180 |
| Comparison Example | | |

TABLE 14-continued

| Epoxy compound | | |
|---|---|---|
| 4 Polyethyleneglycol (n = 22) diglycidyl ether | 861 | 587 |
| 5 Laurylalcohol EO (n = 15) glycidyl ether | 171 | 1040 |
| 6 Phenol EO (n = 5) glycidyl ether | 145 | 427 |
| Not processed | — | — |

| Epoxy Compound | Solubility in alkali (%) | Abrasion (class) | Dyeing depth (K/S) | Yellowing index after irradiation |
|---|---|---|---|---|
| Example | | | | |
| 0 Polyglycerol (n = 2) polyglycidyl ether | 9.2 | 5 | 3.9 | 18.9 |
| 1 Polyglycerol (n = 3) polyglycidyl ether | 10.4 | 5 | 4.1 | 18.8 |
| 2 Ethyleneglycol diglycidyl ether | 11.3 | 5 | 4.5 | 17.3 |
| 3 Polyethyleneglycol (n = 4) diglycidyl ether | 14.1 | 5 | 5.6 | 17.6 |
| 4 Polyethyleneglycol (n = 9) diglycidyl ether | 14.5 | 4 | 5.4 | 17.4 |
| 5 Polyethyleneglycol (n = 13) diglycidyl ether | 13.6 | 4 | 5.2 | 17.5 |
| 6 Polypropyleneglycol (n = 3) diglycidyl ether | 13.0 | 5 | 5.6 | 17.2 |
| Comparison Example | | | | |
| 4 Polyethyleneglycol (n = 22) diglycidyl ether | 49.0 | 2 | 11.8 | 24.7 |
| 5 Laurylalcohol EO (n = 15) glycidyl ether | 63.6 | 1 | 14.9 | 21.5 |
| 6 Phenol EO (n = 5) glycidyl ether | 39.6 | 2 | 7.3 | 22.3 |
| Not processed | 80.1 | 1 | 21.0 | 25.1 |

EO: Ethylene oxide

What is claimed is:

1. Silk fiber crosslinked with an epoxy compound having at least two epoxy groups wherein the solubility of the silk fiber is at most 30% by weight when the silk fiber is soaked in an aqueous 5 wt.% sodium hydroxide solution at a temperature of 65° C. for 60 minutes, and dyeing depth, K/S, at 520 nm with 9% owf. of a red reactive dye, Color Index Reactive Red 63 at the temperature of 60° C. for 60 minutes is at most 7, prepared by treating a silk fiber with an aqueous solution containing a water-soluble epoxy compound and a catalyst selected from the group consisting of alkali metal and alkali earth metal salts of dicarboxylic acids, tricarboxylic acids and amino polycarboxylic acids, 2-methyl imidazole, triethylenetetramine, 2,4,6-tris (dimethylaminoethyl) phenol and magnesium chloride and then subjected to heat treatment at a temperature range of 50° C. to 150° C.

2. The silk fiber according to claim 1, wherein the solubility is at most 20% by weight and the dyeing depth is at most 5.

3. A method of preparing the silk fiber of claim 1, wherein an aqueous solution containing a water-soluble epoxy compound and a catalyst selected from the group consisting of alkali metal and alkali earth metal salts of dicarboxylic acids, tricarboxylic acids and amino polycarboxylic acids, 2-methyl imidazole, triethylenetetramine, 2,4,6-tris(dimethylaminomethyl) phenol and magnesium chloride is applied to the silk fiber, and the thus treated fiber is then subjected to heat treatment at a temperature in the range of 50° C. to 150° C.

4. The method according to claim 3, wherein the dicarboxylic acids are oxalic acid, malonic acid, succinic acid, maleic acid, fumaric acid, phthalic acid, tartaric acid and malic acid; the tricarboxylic acid is citric acid; and the amino polycarboxylic acids are ethylenediaminetetraacetic acid and diethylenetriaminepentaacetic acid.

5. The method of preparing the silk fiber of claim 1, wherein an aqueous processing liquid containing a water-soluble epoxy compound and a catalyst is applied to the silk fiber and the fiber is allowed to stand at room temperature while preventing transpiration of the water, wherein an aqueous solution of the catalyst alone without the epoxy compound has a pH of less than 11 and the processing liquid containing the water-soluble epoxy compound and the catalyst has a pH of at least 9 up to 12.

6. The method according to claim 5, wherein the silk fiber is allowed to stand at 10° to 40° C. for at least 20 hours.

7. The method according to claim 5, wherein the catalyst is selected from the group consisting of neutral salts, weakly alkaline salts, amines and acid salts.

8. The method according to claim 5, wherein a the neutral salts are sodium salts and potassium salts of sulfuric acid, hydrochloric acid, nitric acid, thiocyanic acid and thiosulfuric acid; the weakly alkaline salts are sodium salts and potassium salts of tartaric acid, citric acid, acetic acid and propionic acid; the amines are ethylenediamine, diethylenetriamine, triethylenetetramine, dimethylaminopropylamine, m-phenylenediamine, 2,4,6-tris (dimethylaminomethyl) phenol, 2-methylimidazole and dimethylaniline; and the acid salt is magnesium chloride.

9. Silk fiber crosslinked with an epoxy compound having at least two epoxy groups, wherein the solubility of the silk fiber is at most 30% by weight when the silk fiber is soaked in an aqueous 5 wt.% sodium hydroxide solution at a temperature of 65° C. for 60 minutes, and dyeing depth, K/S, at 520 nm with 9% owf. of a red reactive dye, Color Index Reactive Red 63, at the temperature of 60° C. for 60 minutes is at most 7 prepared by treating a silk fiber with an aqueous processing liquid containing a water-soluble epoxy compound and a catalyst is applied to the silk fiber and the fiber is allowed to stand at room temperature while preventing transpiration of the water, wherein an aqueous solution of the catalyst alone without the epoxy compound has a pH of less than 11 and the processing liquid containing the water-soluble epoxy compound and the catalyst has a pH of at least 9 up to 12.

10. The silk fiber according to claim 9, wherein the solubility is at most 20% by weight and the dyeing depth is at most 5.

* * * * *